United States Patent [19]

Lendvay et al.

[11] 4,248,252

[45] Feb. 3, 1981

[54] CONTINUOUS PROCESS FOR EXPANDING TOBACCO

[75] Inventors: Andrew T. Lendvay, Richmond, Va.; Billy M. Spann, Oak Ridge, Tenn.

[73] Assignee: Philip Morris Incorporated, New York, N.Y.

[21] Appl. No.: 912,029

[22] Filed: Jun. 2, 1978

[51] Int. Cl.[3] ..... A24B 3/18

[52] U.S. Cl. ..... 131/140 P

[58] Field of Search ..... 131/17 R, 140 P

[56] References Cited

U.S. PATENT DOCUMENTS

| | | | |
|---|---|---|---|
| 3,214,928 | 11/1965 | Oberdorfer | 131/140 P |
| 3,425,425 | 2/1969 | Hind | 131/140 P |
| 3,771,533 | 11/1973 | Armstrong et al. | 131/17 R |

FOREIGN PATENT DOCUMENTS

| | | | |
|---|---|---|---|
| 1331640 | 9/1973 | United Kingdom | 131/140 P |

*Primary Examiner*—V. Millin

*Attorney, Agent, or Firm*—Watson, Leavenworth, Kelton & Taggart

[57] ABSTRACT

A continuous process of expanding tobacco with carbon dioxide and ammonia is disclosed which comprises contacting tobacco with concentrated ammonium hydroxide, mixing the ammonium hydroxide-treated tobacco with ground solid carbon dioxide, thereafter expanding the tobacco by means of heat and equilibrating the expanded tobacco until equilibrium moisture content is attained. Concentrated aqueous solutions of ammonium carbamate may be substituted for the ammonium hydroxide and solid carbon dioxide in the process. The tobacco may be expanded in an atmosphere of hot steam or gas, or by means of microwave or radiant heat energy. The process allows impregnation and expansion of tobacco to be effected without interruption on a production line.

6 Claims, No Drawings

CONTINUOUS PROCESS FOR EXPANDING TOBACCO

BACKGROUND OF PRIOR ART

The desirability of increasing the bulk or volume of tobacco has long been recognized. Among the various reasons for desiring such increase in bulk or volume are compensation for the weight loss caused by the curing process. Increase in filling power permits the use of smaller amounts of tobacco in the production of firm cigarette rods or the like and results in a lower delivery of tar and nicotine than a comparable product made of unexpanded tobacco.

Different methods have been suggested in the art for expanding the volume of tobacco. For example, in U.S. Pat. No. 1,789,435 to Hawkins, tobacco is expanded by subjecting tobacco to a gas under pressure, which causes the gas to penetrate the constituents of the tobacco. Thereafter, the pressure is suddenly released whereupon the gas trapped in the tobacco expands. Among the gases mentioned as usable in the process are air, carbon dioxide and steam. The gas may be heated to facilitate the process.

According to the method of British Pat. No. 1,331,640, tobacco is impregnated with a compound capable of liberating a gas under conditions which do not impair the quality of tobacco. Nongaseous chemical compounds which liberate gases, such as carbon dioxide, nitrogen, oxygen and ammonia, upon thermal decomposition may be employed. Preferred compounds are those which decompose at relatively low temperatures including ammonium carbonates, ammonium carbamates, organic dicarboxylic acids and peroxides.

Tobacco expansion processes for enhancing the utility of tobacco stems for use in tobacco products are described in U.S. Pat. Nos. 3,409,022, 3,409,023, 3,409,027 and 3,409,028 all to Burde. According to the processes described, tobacco stems are expanded by means of radiant heat or microwave energy. A method of reducing post-expansion shrinkage of tobacco stems and a method of preparing reconstituted tobacco sheets from puffed tobacco are also described. A further enchancement of the puffed product obtained from tobacco stems is described in U.S. Pat. No. 3,425,425 to Hind. In this patent, tobacco stems are treated with a solution of water-soluble carbohydrate prior to expansion.

In U.S. Pat. No. 3,771,533 to Armstrong et al., the various disadvantages of these and other prior art processes of tobacco expansion are noted. For example, some of the methods involve only moderate expansion, are not effective on tobacco leaf as well as tobacco stem, require elaborate and expensive equipment and/or involve introduction of foreign materials into the tobacco.

According to the expansion method of the Armstrong et al. patent, tobacco is treated with liquid or gaseous ammonia or with ammonium hydroxide or a combination of ammonia and carbon dioxide followed by heating to temperatures of from 250° F. to 700° F. for a time sufficient to puff the tobacco. Carbon dioxide may be added before, during or after the ammonia is introduced. The carbon dioxide may be introduced as a gas, or in powdered form, or in combination with the ammonia in the form of ammonium carbonate or bicarbonate which may be applied directly or formed in situ.

When the method of Armstrong et al. is used, many of the prior art problems of tobacco expansion are overcome. For example, the process is relatively inexpensive, has application to both tobacco stems and tobacco leaves, and greater and more permanent expansion of the tobacco is obtained. However, the Armstrong method, along with most other batch processes currently employed for tobacco expansion, is not entirely satisfactory for continuous online impregnation and expansion of tobacco due to certain requirements of these prior art batch methods.

For example, where carbon dioxide gas and ammonia vapors or gas are used as impregnants in prior art batch methods, pressure and heat build-up are created in a closed system as the result of the heat of solution of ammonia and the exothermic reaction of the ammonia, carbon dioxide and the moisture present in the tobacco in forming ammonium salts. Cooling by means of a water jacket or the like, reduced pressure, and/or agitation, is needed in order to disipate this heat build-up. If ammonium carbonate or bicarbonate is used to supply the expansion agents, it may be necessary to use reduced pressures and subject the tobacco to the ammonium carbonates in an enclosed zone for 24 to 96 hours. Alternatively, ammonium carbonate or bicarbonate may be applied to the tobacco as a dust and then held for 18 to 96 hours. A still further method involves contacting the tobacco with ammonium carbonate or bicarbonate salts suspended or partially dissolved in a suitable liquid medium for about 1 to 48 hours with the solvent being removed by exposing the tobacco to a flow of inert gas or air before puffing. The necessity for cooling means, reduced pressure or vacuum and/or long periods for impregnation or equilibration of these methods, hampers the application of such methods to continuous on-line processes.

A further problem in the conversion of existing batch impregnation processes to continuous processes is the formation of hard balls of ammonium salts within the tobacco mass and the buildup of salt deposits on the impregnator walls and in the head spaces. These difficult-to-remove salt deposits on the equipment must be removed between batches for efficient batch processing. In addition, the formation of large lumps of ammonium salts and tobacco within the tobacco mass reduces the amount of usable shredded tobacco material, reduces efficiency and increases cost.

Thus, current batch processes of tobacco expansion introduce a variety of factors which complicate and impede continuous on-line tobacco impregnation and expansion. Therefore, current batch processes do not provide a completely satisfactory means for accomplishing continuous on-line tobacco impregnation and expansion.

BRIEF SUMMARY OF INVENTION

This invention relates to a continuous process of expanding tobacco comprising the steps of contacting tobacco with concentrated ammonium hydroxide, holding the thus treated tobacco for at least one minute, mixing the thus treated tobacco with finely ground solid carbon dioxide, expanding the mixed tobacco by means of heat, and thereafter equilibrating the expanded tobacco to equilibrium moisture content. Concentrated aqueous ammonium carbamate may be substituted for the ammonium hydroxide and solid carbon dioxide.

By means of the process of the invention, impregnation and expansion can be carried out continuously on-line in a manufacturing process at ambient pressure with the evolution of minimal heat and substantial elimination of ammonium salt build-up in the system. The tobacco which is processed in accordance with the invention has a significantly increased volume with equal or comparable subjective acceptability to tobacco expanded in batch processes.

DETAILED DESCRIPTION OF INVENTION

In accordance with this invention, a continuous process for impregnation and expansion of tobacco using ammonium hydroxide and solid carbon dioxide or aqueous ammonium carbamate as impregnants is provided. Surprisingly, we have found that impregnation can be carried out rapidly at ambient pressure with impregnation typically being completed within 10 to 20 minutes and with little or no heat being evolved. In addition, no troublesome build-up of ammonium salts in the headspaces of equipment and substantially no formation of ammonium salt lumps within the bulk of the shredded tobacco are encountered. The process may be used continuously with the impregnation zone directly before the expansion zone without encountering the problems attendant to prior patented processes.

In the practice of the invention, tobacco is contacted with a solution of ammonium carbamate, or using a sequential treatment, with aqueous ammonium hydroxide and then solid carbon dioxide which is preferably in a comminuted form. The tobacco is then conveyed to an expansion zone where the impregnated tobacco may be expanded by circulating and blowing the tobacco, possibly in a cyclone manner, in a heated air or steam atmosphere or by means of radiant heat or microwave energy. Upon exiting from the expansion zone, the tobacco is equilibrated at 24° C. and 60% relative humidity, whereupon a significant volume increase in the tobacco is observed.

The process of the invention may be employed to treat reconstituted tobacco, selected parts of tobacco, such as tobacco stems, tobacco in cut or chopped form or whole cured tobacco leaf. Where reconstituted tobacco is employed, it is preferably used in shredded form.

More particularly, the process of the invention is a continuous impregnation-expansion method which can be used without interruption on a production line basis in a manufacturing process. According to the invention, tobacco may be fed continuously into an enclosed conveyor such as a vibratory conveyor and/or a rotary drum where it it sprayed or otherwise contacted with ammonium hydroxide. Concentrated aqueous solutions having 30 to 60 percent ammonia concentration are preferred. If desired, the ammonium hydroxide solutions may be chilled prior to contact with the tobacco, both to reduce vapor pressure and to offset the heat of reaction upon addition of the ammonium hydroxide and carbon dioxide to the tobacco.

Generally, sufficient ammonium hydroxide for penetration into the tobacco of at least one weight percent of ammonia should be used. Preferably, the tobacco is contacted with an ammonium hydroxide solution for a period of time sufficient to impregnate the tobacco with about 2.5 to 10 percent ammonia based on the weight of the tobacco. The tobacco must remain in contact with the ammonium hydroxide for a period of time sufficient to allow the ammonium hydroxide to penetrate the tobacco. Although ammonia readily penetrates tobacco, the ammonium hydroxide-treated tobacco is preferably blended or agitated gently to insure efficient and uniform absorption. By tumbling or vibrating the tobacco for at least one minute and generally no more than 10 minutes, sufficient and uniform absorption may be effected.

After absorption of the ammonium hydroxide, the tobacco is contacted with solid carbon dioxide, preferably in comminuted form. The amount of carbon dioxide used should be sufficient to counteract the heat of reaction of the carbon dioxide, ammonia and moisture and to release enough carbon dioxide to accomplish the second stage of impregnation. Pulverized solid carbon dioxide in an amount equal to two times the stoichiometric quantity of ammonium hydroxide employed is generally adequate to provide sufficient carbon dioxide for absorption into the tobacco of between 2 and 8 percent by weight of carbon dioxide and to maintain a relatively low temperature in the system. Preferably, the tobacco is combined with the ground solid carbon dioxide in a manner which insures uniformity within the tobacco and for a period of time which allows complete reaction of carbon dioxide and ammonium hydroxide. Thus, as with the ammonium hydroxide, the tobacco is preferably mixed with the carbon dioxide, employing vibratory or rotary means, for at least one and generally no more than 10 minutes. After mixing, the impregnated tobacco is conveyed to an expansion zone wherein the tobacco is expanded and thereafter allowed to attain equilibrium moisture content.

Concentrated aqueous solutions of ammonium carbamate may be substituted for the ammonium hydroxide and solid carbon dioxide. Ammonium carbamate solutions having 40–60% salt by weight are preferred. In those cases where aqueous ammonium carbamate is employed, the impregnated tobacco may be conveyed directly to the expansion zone after blending with the carbamate. This is due to the fact that mixing with solid carbon dioxide is unnecessary since ammonium carbamate provides both impregnator agents, that is, ammonia and carbon dioxide gas, without substantial evolution of heat. The ammonium carbamate may itself be manufactured economically on-line by reacting liquid anhydrous ammonia and solid carbon dioxide or liquid carbon dioxide.

Use of a wetting agent in the impregnant spray will facilitate impregnation. In addition, the tobacco may be partially dried to about 5 to about 9% by weight moisture prior to impregnation to reduce the amount of water contained in the impregnated feed, thereby improving the tobacco's ability to more readily absorb ammonium hydroxide. As used herein, percent moisture may be considered equivalent to oven volatiles (OV) since not more than about 0.9% of tobacco weight is volatiles other than water. Oven volatiles may be determined by a simple measurement of weight loss on exposure in a forced air oven for 3 hours at 100° C.

Use of either the ammonium hydroxide-solid carbon dioxide combination, or aqueous ammonium carbamate avoids the problems of heat build-up, due to the heat of solution of ammonia in water, which is encountered when dry or gaseous ammonia and carbon dioxide are used as impregnants in moist tobacco. Thus, with either variation in the continuous method of the invention, no separate cooling arrangement is necessary and neither vacuum nor pressure of any kind is required.

In addition to avoiding the problems of heat build-up and thereby simplifying current batch processes, the method of the invention is more conveniently used as a continuous production line process due to the relatively short periods of time required for pretreatment of the tobacco prior to expansion. The period required for impregnation with the ammonia and the carbon dioxide generally totals no more than about 30 minutes and may be substantially less. In practice, good expansion is obtained with impregnation times of 20 minutes or less prior to being introduced into the expansion zone. The method of the invention is simpler and/or faster than any batch processes with resultant savings in space, equipment and man-power requirements. Thus, the tobacco expansion process of the invention is a suitable continuous production line method.

Further, where the method of the invention is employed, difficult-to-remove ammonium salt deposits on the equipment and/or large lumps of tobacco caused by ammonium salt build-up within the tobacco mass are reduced or eliminated completely. This is believed to be due to the fact that ammonia and carbon dioxide react within the tobacco when the method of the invention is used. In contrast, in the batch processes, some of the gaseous ammonia and carbon dioxide tend to partially react in the headspace (i.e., not within the tobacco), thus reducing the quantity of reactions in the tobacco. Since salt build-up is minimized, the method of the invention can be used continuously with relatively infrequent cleaning of equipment being required. In addition, since there are minimal lumps within the bulk of the shredded tobacco, the tobacco can be passed directly to an expansion device from the impregnation zone. Further, materials' loss is significantly reduced due to the elimination of salt build-up. Thus, the process of the invention not only may be used efficiently as a continuous production line method, but is also more economical than many batch processes.

Following the impregnation of the tobacco by the means described above, the tobacco is exposed to expansion conditions such as heat or the equivalent in order to remove ammonia and carbon dioxide from the tobacco. The expansion conditions may comprise the use of hot surfaces, or a stream of hot air, a mixture of gases and steam, or exposure to other energy sources, such as microwave energy or infrared radiation. It has been found that the use of a gas composition comprising at least 50% (by weight) of steam, and preferably above 80% (by weight) of steam, provides particularly satisfactory results. A convenient means of expanding the impregnated tobacco is to place it or to entrain it in a stream of heated gas, such as superheated steam or to place it in a turbulent air stream maintained, for example, at a temperature of from about 150° to about 260° C. (as low as 100° C. and as high as 370° C.) for a period of about 1 second to 10 minutes. The impregnated tobacco may also be heated by being placed on a moving belt in a thin layer and exposed to infrared heating, by exposure in a cyclone dryer, by contact in a tower with superheated steam or a mixture of steam and air or the like. Any such contacting steps should not raise the temperature of the atmosphere with which the tobacco is in contact to above about 370° C. and should preferably be from at about 100 to about 300° C., most preferably 150° to 260° C. when conducted at atmospheric pressure.

As is well known in the processing of any organic matter, overheating can cause damage, first to color, such as undue darkening, and finally, to the extent of charring. The necessary and sufficient temperature and exposure time for expansion without such damage is a function of these two variables as well as the size of the tobacco particles. Thus, to avoid undesirable damage in the heating step, the impregnated tobacco should not be exposed to the higher temperature levels, e.g., 370° C., longer than 1 to 2 seconds.

Expansion of the tobacco cells may be achieved by radiant heat method described in U.S. Pat. Nos. 3,409,022 and 3,409,023. When radiant energy is used, the temperature of the toabcco should be brought to a level of from about 30° C. to about 240° C. and preferably from about 30° C. to about 190° C. to achieve expansion. Temperatures in the range of about 20° C. to 150°C. are generally employed when using microwave energy.

Another system, usually preferred, is to use a dispersion dryer, for example, one that is supplied either with steam alone or in combination with air. An example of such a dryer is a Proctor & Schwartz PB dispersion dryer, usually called hereafter a tower. The temperature in the dryer may range from about 120 to 370° C. with contact time in the dryer of about 1 to 10 seconds. In general, a 1 to 6 second contact time is utilized when the hot gas temperature is 260° to 315° C. or somewhat higher. As stated before, other known types of heating means may be used as long as they are capable of causing the impregnated tobacco to expand without excessive darkening. The presence of a steam atmosphere of 20% or more of the total hot gas composition aids in obtaining the best expansion; a high proportion (e.g., over 80% volume) of steam is preferred.

Following impregnation and expansion, the tobacco is allowed to equilibrate, typically at 24° C. and 60% relative humidity. Following such equilibration, tobacco filler having substantially increased compacimetric filling power with no detectable change in quality is obtained. The expanded tobacco is very similar in chemical and physical characteristics to conventional expanded tobacco. The increase in filling power of tobacco expanded in accordance with the invention is at least that of currently available expanded tobaccos and may vary between about 30 and 160% with oven volatiles at around 12%. Expansion to cylinder volumes of 70 cc/10 g or more were achieved using the continuous impregnation expansion process of the invention. Microscopy shows good cellular expansion and an increase in shred size of about 100% over unexpanded tobaccos.

Chemical analyses of ammonium hydroxide-solid carbon dioxide expanded tobacco indicate a slightly higher content of unreacted sugars compared to some available expanded tobaccos. This increased content of unreacted sugars is believed to have a beneficial effect on the subjective acceptability of expanded tobacco made in accordance with the invention. The higher sugar content is probably the result of the reduction in bulking time after impregnation of the process of the invention which results in less reaction between the sugars and the ammonia present. In addition, although the tobacco impregnated in accordance with the process of the invention has a higher mositure level due to the moisture in the impregnant spray, such moisture does not have a detrimental effect on product expansion or quality.

One embodiment according to the process of the invention, wherein tobacco filler may be impregnated and expanded without interruption on a manufacturing line, is as follows. Tobacco is fed into a closed vibratory conveyor into which is sprayed ammonium hydroxide having a 40 to 50% concentration of ammonia at a rate sufficient to provide at least 1% ammonia relative to the weight of the tobacco. The tobacco is then conveyed along the vibratory conveyor for sufficient time to insure uniform absorption. The tobacco is then dropped onto a conveyor and into a rotary drum containing finely crushed solid carbon dioxide. Typically twice the stoichiometric quantity of solid carbon dioxide relative to the ammonium hydroxide used is employed. The tobacco and solid carbon dioxide are rotated in a rotary drum or mixed by any convenient means for 1 to 10 minutes to permit complete reaction of the impregnants and tobacco moisture.

Following rotation, the tobacco is conveyed from the impregnation zone directly to an expansion tower where it may be exposed to high velocity heated air or steam and then conveyed to a cyclone separator where it is swirled. Alternatively, the rotary drum may be emptied onto a continuously moving conveyor belt which passes the tobacco under a radiant energy source such as an infrared lamp. Thereafter, the tobacco is equilibrated before being further treated or being incorporated into a tobacco product.

The following examples are illustrative and are not to be taken in a limiting sense.

EXAMPLE 1

Ten pounds of cased bright tobacco which contained 12% oven volatiles (OV) was sprayed with a 50% weight by volume (W/V) solution of ammonium carbamate using 30 m per each 100 g of tobacco. The impregnation was carried out in a rotating drum and the spraying lasted two minutes. The tobacco was tumbled in the drum for another three minutes to permit uniform distribution of the spraying solution.

The impregnated tobacco was then fed into a tower for expansion. Within the tower, air heated to 288° C. was circulated at a velocity of 100 feet per second to keep the tobacco in motion. The tobacco remained in the experimental tower about one second and then was swirled around in the cyclone separator for about four seconds. The tobacco was then equilibrated at about 24° C. and 60% relative humidity (RH) to leave approximately 12% oven volatiles in the tobacco.

The filling power of the tobacco thus treated when determined by the cylinder-volume method showed a 95% increase. The method for cylinder-volume measurements is described in Wakeham et al., "Filling Volume of Cut Tobacco and Cigarette Hardness," *Tobacco Science,* Volume XX, pages 164–167 (1976), the disclosures of which are incorporated herein by reference.

EXAMPLE 2

Uncased bright tobacco (8.8 pounds) was wetted with 475 m of 12.5% ammonium hydroxide solution. The spraying of the tobacco with the solution was carried out in a rotating drum for 40 seconds. After tumbling the material for another 60 second, ground solid carbon dioxide was added and the batch was tumbled for two minutes. The tobacco thus impregnated was then exposed to steam heated to 260° C. in an experimental tower. The impregnated tobacco remained in the experimental tower about one second for the heated-steam treatment and then was swirled in a cyclone separator for about four seconds. The tobacco was equilibrated as described in Example 1. After equilibration, the filling power, as determined by the cylinder-volume method, had increased by 73% with the oven volatiles at 11.5%.

EXAMPLE 3

Ten pounds of cased tobacco shreds were sprayed in a rotating drum for one-half minute with 400 m of concentrated ammonium hydroxide and tumbled for another 60 seconds. Following the liquid spray, two pounds of ground solid carbon dioxide were mixed with the sprayed tobacco shreds in the rotating drum for two minutes. The tobacco mixture was then exposed to full steam at 288° C. in the experimental tower for one second and then was swirled in the cyclone separator for about four seconds. The tobacco was equilibrated as described in Example 1. After equilibration, the filling power, determined as in Example 1, had increased 120% with the oven volatiles at 11.5%.

Example 4

Sixty-eight pounds of shredded bright tobacco containing 12.5% moisture was put into a closed container, specifically a Stokes Model 159-2 conical rotating vacuum drum and impregnated by spraying with 12 pounds of 40% by weight aqueous ammonium hydroxide through a fog nozzle while the tobacco was being rotated. Twenty minutes was allowed for the ammonium hydroxide to penetrate the tobacco. The rotation was then interrupted and 10½ pounds of powdered solid carbon dioxide were added. The tobacco was rotated for an additional 10 minutes during which the ammonium hydroxide and carbon dioxide reacted. The impregnated tobacco contained 6.3% by weight of ammonia and 6.8% by weight of carbon dioxide.

The container was emptied and the impregnated tobacco was expanded by dropping it at a continuous rate of one pound per minute into a stream of steam at 218° C. The velocity of the steam was 150 feet per second. After equilibration at 60% RH and 24° C., the bulk volume of the expanded tobacco was 133% greater than before impregnation and expansion.

Example 5

Thirty-four pounds of shredded bright tobacco containing 12.0% moisture was put into a closed container and impregnated by spraying with 6¼ pounds of 40% by weight aqueous ammonium hydroxide through a fog nozzle while rotating the tobacco. Thirteen minutes were allowed for the ammonium hydroxide to penetrate the tobacco. The rotation was interrupted, and 5¼ pounds of powdered solid carbon dioxide were added. The container was rotated for an additional 10 minutes to permit reaction of the ammonium hydroxide and carbon dioxide. The impregnated tobacco contained 5.7% ammonia by weight and 6.6% carbon dioxide by weight. The container was emptied, and the impregnated tobacco was expanded by spreading it in a thin layer on a continuously moving conveyor belt which passed it under high-intensity infrared heaters. After equilibration at 60% RH and 24° C., the bulk volume of the expanding tobacco was 85% greater than before impregnation and expansion.

Example 6

Using the same procedures described in Example 5, 29 pounds of shredded bright tobacco containing 9.1% moisture was sprayed with 10 pounds of 35% by weight of ammonium carbamate at 4.5° C. The impregnated tobacco contained 5.5% by weight of ammonia and 5.3% by weight of carbon dioxide. The impregnated tobacco was expanded by dropping it at a continuous rate of one pound per minute into a stream of steam at 204° C. having a velocity of 150 feet per second. After equilibration at 60% RH and 24° C., the bulk volume of the expanded tobacco was 122% greater than before impregnation and expansion.

Example 7

Shredded tobacco containing 12% moisture was introduced at 240 pounds per hour by a metering conveyor into an enclosed vibratory conveyor. As it was introduced, aqueous ammonium carbamate with a concentration of 50% by weight was sprayed at the rate of 1.1 pounds per minute onto the moving bed of tobacco by a fog nozzle. The impregnated tobacco was dropped from the vibratory conveyor onto an enclosed moving conveyor passing through a rotary drum where 10 minutes was permitted for complete penetration of the ammonium carbamate solution into the tobacco. The impregnated tobacco was then expanded by dropping it in a continuous steam into a high velocity turbulent stream of steam at 260° C. The bulk volume of the tobacco thus treated increased by 150% over the untreated tobacco.

We claim:

1. The continuous process of expanding tobacco comprising the steps of:

a. contacting tobacco with concentrated ammonium hydroxide in an amount sufficient to introduce at least one percent by weight of ammonia;

b. allowing the tobacco to remain in contact with the ammonium hydroxide for at least one minute;

c. combining the ammonium hydroxide-treated tobacco with sufficient solid carbon dioxide in comminuted form to counteract the heat of reaction of the carbon dioxide, ammonia and tobacco moisture and to release enough carbon dioxide for absorption into the tobacco of between 2 and 8 percent by weight of carbon dioxide;

d. thereafter expanding the tobacco by means of heat; and e. equilibrating the tobacco after it has been expanded.

2. The process of claim 1, wherein the step of combining the blended tobacco with solid carbon dioxide is carried out using about twice the stoichiometric amount of solid carbon dioxide relative to ammonium hydroxide.

3. The process of claim 1, wherein the step of contacting tobacco with ammonium hydroxide is carried out until the amount of ammonia impregnated in the tobacco is between 2.5 and 10 percent based on the weight of the tobacco.

4. The process of claim 1, wherein the step of allowing the tobacco to remain in contact with the ammonium hydroxide is carried out while vibrating the tobacco on an enclosed vibratory conveyor.

5. The process of claim 1, wherein the step of expanding the tobacco is carried out by conveying the tobacco in a thin layer in proximity to a radiant heat source.

6. The process of claim 1, wherein the step of expanding the tobacco is carried out by conveying the tobacco in proximity to a microwave energy source.

* * * * *